US010336523B2

(12) United States Patent
Fu

(10) Patent No.: US 10,336,523 B2
(45) Date of Patent: Jul. 2, 2019

(54) TAPE AND REEL PACKING MATERIAL

(71) Applicant: Winbond Electronics Corp., Taichung (TW)

(72) Inventor: Ting-Ming Fu, Hsinchu County (TW)

(73) Assignee: WINBOND ELECTRONICS CORP., Taichung (TW)

( * ) Notice: Subject to any disclaimer, the term of this patent is extended or adjusted under 35 U.S.C. 154(b) by 0 days.

(21) Appl. No.: 15/868,311

(22) Filed: Jan. 11, 2018

(65) Prior Publication Data

US 2018/0208378 A1 Jul. 26, 2018

(30) Foreign Application Priority Data

Jan. 26, 2017 (CN) ..... 2017 1 0057372

(51) Int. Cl.

| | |
|---|---|
| ***B65D 73/02*** | (2006.01) |
| ***B65D 85/42*** | (2006.01) |
| ***B65D 75/32*** | (2006.01) |
| ***B65D 85/30*** | (2006.01) |
| ***B65D 81/05*** | (2006.01) |
| ***B65D 85/672*** | (2006.01) |

(52) U.S. Cl.

CPC ..... *B65D 75/327* (2013.01); *B65D 73/02* (2013.01); *B65D 81/05* (2013.01); *B65D 85/30* (2013.01); *B65D 85/672* (2013.01); *B65D 2575/329* (2013.01)

(58) Field of Classification Search

CPC ..... B65D 73/02; B65D 75/327; B65D 81/05; B65D 85/30; B65D 85/672; B65D 2575/329; H05K 13/0084

USPC ..... 206/713–717, 591, 594

See application file for complete search history.

(56) References Cited

U.S. PATENT DOCUMENTS 4,241,829 A * 12/1980 Hardy ..... B65D 5/563 206/523
5,234,104 A * 8/1993 Schulte ..... B65D 73/02 206/341
5,499,717 A * 3/1996 Hayashi ..... B65D 73/02 206/390
5,673,795 A * 10/1997 Clatanoff ..... H05K 9/0067 174/521

(Continued)

FOREIGN PATENT DOCUMENTS

CN 1117933 A 3/1996
CN 1511769 A 7/2004

(Continued)

OTHER PUBLICATIONS

Intellectual Property Adminstration of the People's Republic of China, Office Action, dated Jan. 21, 2019, 8 pages.

*Primary Examiner* — Luan K Bui

(74) *Attorney, Agent, or Firm* — Muncy, Geissler, Olds & Lowe, P.C.

(57) ABSTRACT

A tape and reel packing material for packaging a plurality of chips is provided. The tape and reel packing material includes a carrier tape and a cover tape. The carrier tape includes a plurality of recesses. The recesses are configured to receive the chips respectively. The cover tape is attached to the carrier tape. The cover tape includes a plurality of restriction structures, and the restriction structures respectively are inserted into the recesses to restrict the freedom of the movement of the chips.

7 Claims, 5 Drawing Sheets

(56) References Cited

U.S. PATENT DOCUMENTS

| | | | | |
|---|---|---|---|---|
| 6,216,419 | B1 * | 4/2001 | Sakurai | B65B 9/045 206/713 |
| 6,540,086 | B1 * | 4/2003 | White, Jr. | H05K 13/0084 206/713 |
| 8,205,766 | B2 * | 6/2012 | Jewram | H05K 7/20472 206/714 |
| 2006/0157382 | A1 * | 7/2006 | Yasufuku | H05K 13/0084 206/714 |
| 2015/0108038 | A1 * | 4/2015 | Hsu | H05K 13/0084 206/714 |

FOREIGN PATENT DOCUMENTS

| | | | |
|---|---|---|---|
| CN | 203127445 | U | 8/2013 |
| CN | 106029807 | A | 10/2016 |
| JP | 2005096789 | A | 4/2005 |

* cited by examiner

TAPE AND REEL PACKING MATERIAL

CROSS REFERENCE TO RELATED APPLICATIONS

This Application claims priority of China Patent Application No. 201710057372.1, filed on Jan. 26, 2017, the entirety of which is incorporated by reference herein.

BACKGROUND OF THE INVENTION

Field of the Invention

The present invention relates to a tape and reel packing material, and in particular to a tape and reel packing material with increased reliability.

Description of the Related Art

Conventional tape and reel packing material includes the cover tape and the carrier tape. A plurality of recesses are formed on the carrier tape. The chips are respectively received in the recesses. The cover tape is a flat and transparent plastic tape, which is attached to the carrier tape to prevent the chips from falling out of the carrier tape. Conventionally, the space of the recess is large. The chip can collide against the inner wall of the recess during transportation, and become damaged. In particular, damage usually occurs on the lateral surface of the chip. Additionally, if the cover tape is not sufficiently attached to the carrier tape, the chip may leave the recess and get jammed between the cover tape and the carrier tape.

BRIEF SUMMARY OF THE INVENTION

In one embodiment, a tape and reel packing material for packaging a plurality of chips is provided. The tape and reel packing material includes a carrier tape and a cover tape. The carrier tape includes a plurality of recesses. The recesses are configured to receive the respective chips. The cover tape is attached to the carrier tape. The cover tape includes a plurality of restriction structures, and the restriction structures are inserted into the respective recesses to restrict the freedom of movement of the chips.

In one embodiment, the restriction structure comprises a central restriction portion and a peripheral restriction portion. The central restriction portion corresponds to a top surface of the chip to restrict the freedom of the chip in a first direction. The peripheral restriction portion corresponds to a lateral surface of the chip to restrict the freedom of the chip in a second direction and a third direction. The first direction is perpendicular to the second direction and the third direction.

In one embodiment, the central restriction portion comprises a first opening, and the first opening corresponds to the geometric center of the chip.

In one embodiment, the recess comprises a second opening, and the second opening corresponds to the geometric center of the chip.

In one embodiment, the peripheral restriction portion comprises an annular protrusion, and the annular protrusion surrounds the lateral surface of the chip.

In one embodiment, the peripheral restriction portion comprises a plurality of posts. The lateral surface of the chip comprises a first side, a second side, a third side and a fourth side. The posts respectively correspond to the first side, the second side, the third side and the fourth side.

In one embodiment, the peripheral restriction portion comprises a guiding slope and an end surface, the guiding slope is located between the end surface and the central restriction portion, the guiding slope corresponds to the lateral surface of the chip, and an included angle between the guiding slope and a horizontal line is between 65 degrees and 85 degrees.

In one embodiment, the peripheral restriction portion further comprises a rounded edge, and the rounded edge is located between the guiding slope and the end surface.

In one embodiment, the cover tape comprises a first attachment area, a second attachment area, and a restriction area. The first attachment area is parallel to the second attachment area. The restriction area is located between the first attachment area and the second attachment area. The restriction structures are formed on the restriction area. The cover tape is attached to the carrier tape via the first attachment area and the second attachment area.

In one embodiment, the cover tape comprises a substrate, a tie-layer and an adhesive layer in the first attachment area and the second attachment area. The tie-layer is sandwiched between the substrate and the adhesive layer. The adhesive layer is adapted to attach the carrier tape. Only the substrate layer is in the restriction area.

Utilizing the tape and reel packing material of the embodiment of the invention, the cover tape has the restriction structures, and the restriction structures are inserted into the recesses. The freedom of the movement of the chips is restricted, the movement spaces inside the recess for the chips are decreased, and the chips are prevented from collision and damaged during transmission. The chips are also prevented from becoming separated from the recesses.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
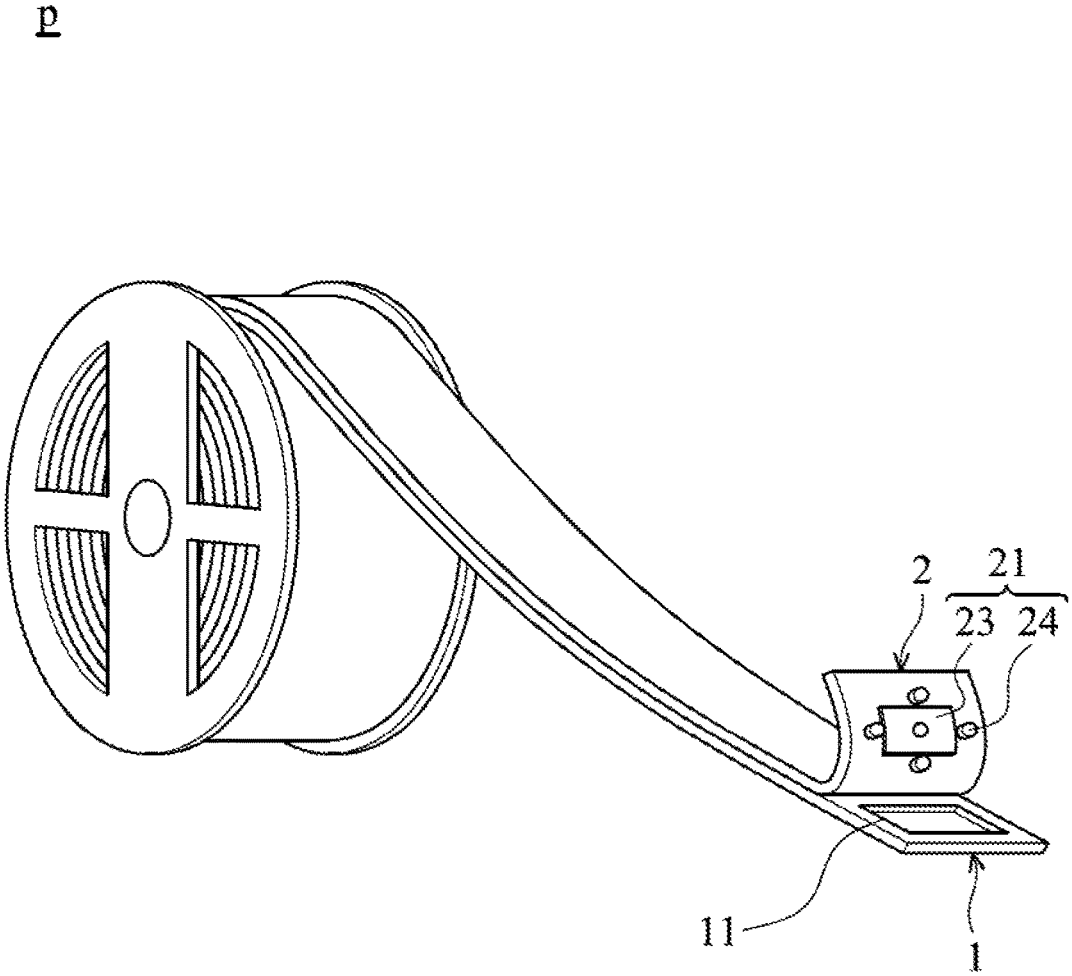
FIG. 1 shows a tape and reel packing material of an embodiment of the invention.

FIG. 1 shows a tape and reel packing material P of an embodiment of the invention. The tape and reel packing material P is utilized for packaging a plurality of chips C. The tape and reel packing material P includes a carrier tape 1 and a cover tape 2. The carrier tape 1 and the cover tape 2 are made of flexible materials. The carrier tape 1 includes a plurality of recesses 11. The recesses 11 are configured to receive the respective chips C. The cover tape 2 is attached to the carrier tape 1. The cover tape 2 includes a plurality of restriction structures 21, and the restriction structures 21 respectively are inserted into the recesses 11 to restrict the freedom of the movement of the chips C.

Figure 2A:
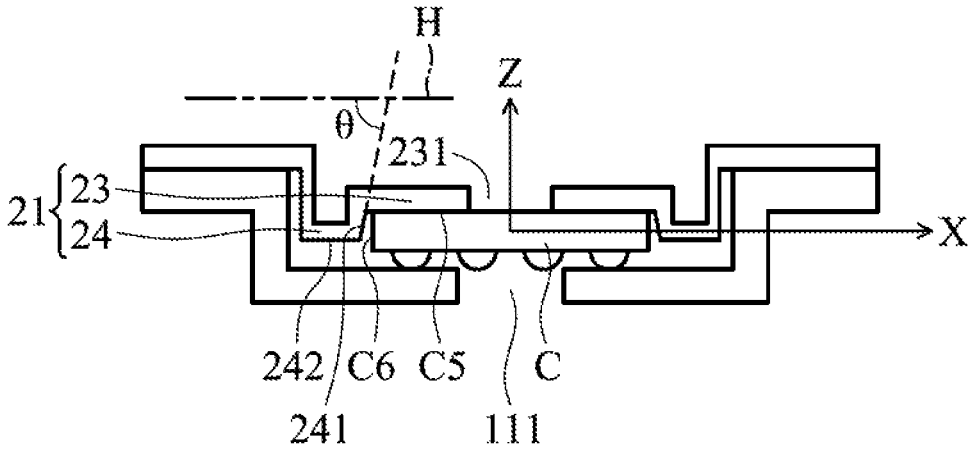
FIG. 2A is a cross-sectional view of the restriction structure of one embodiment of the invention.
Figure 2B:
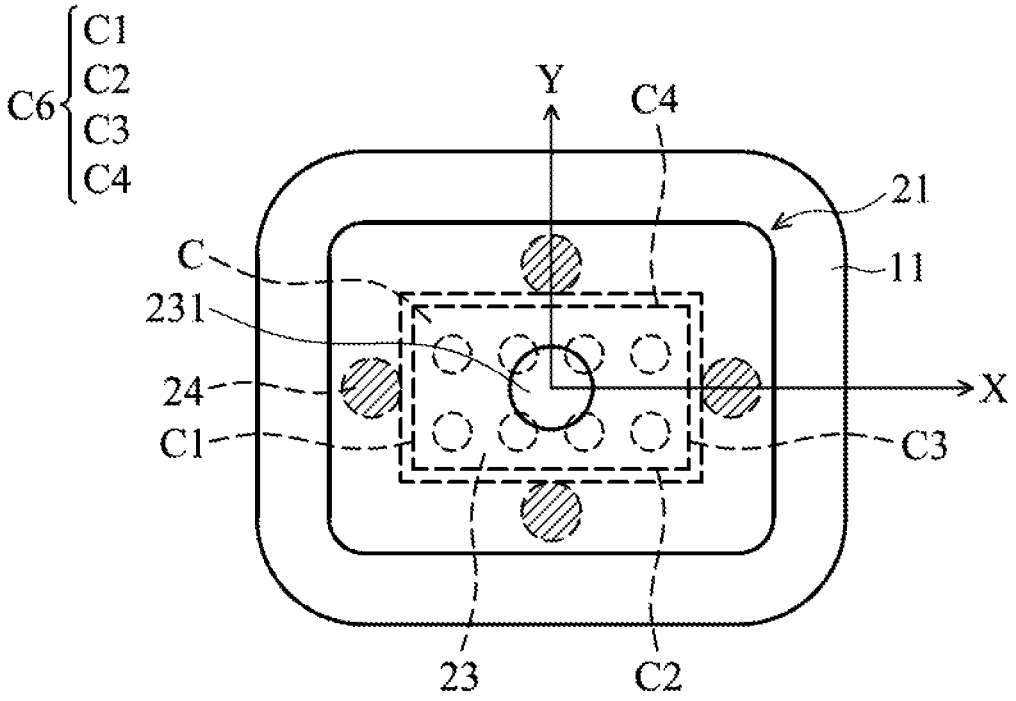
FIG. 2B is a top view of the restriction structure of one embodiment of the invention.

FIG. 2A is a cross-sectional view of the restriction structure 21 of one embodiment of the invention. FIG. 2B is a top view of the restriction structure 21 of one embodiment of the invention. With reference to FIGS. 2A and 2B, in one embodiment, the restriction structure 21 comprises a central restriction portion 23 and a peripheral restriction portion 24. The central restriction portion 23 corresponds to a top surface C5 of the chip C to restrict the freedom of the chip C in a first direction Z. The peripheral restriction portion 24 corresponds to a lateral surface C6 of the chip C to restrict the freedom of the chip C in a second direction X and a third direction Y. The first direction Z is perpendicular to the second direction X and the third direction Y.

Utilizing the tape and reel packing material of the embodiment of the invention, the cover tape has the restriction structures, and the restriction structures are inserted into the recesses, the freedom of the movement of the chips is restricted, the movement spaces inside the recess for the chips are decreased and the chips are prevented from collision and damaged during transmission. The chips are also prevented from becoming separated from the recesses.

With reference to FIGS. 2A and 2B, in one embodiment, the central restriction portion 23 comprises a first opening 231, and the first opening 231 corresponds to the geometric center of the chip C. In one embodiment, the recess 11 comprises a second opening 111, and the second opening 111 corresponds to the geometric center of the chip C. The first opening 231 prevents the chip C from being attached to the cover tape 2. The second opening prevents the chip C from being attached to the carrier tape 1.

With reference to FIGS. 2A and 2B, in this embodiment, the peripheral restriction portion 24 comprises a plurality of posts. The lateral surface C6 of the chip C comprises a first side C1, a second side C2, a third side C3 and a fourth side C4. The posts respectively correspond to the first side C1, the second side C2, the third side C3 and the fourth side C4 to restrict the freedom of the chip C in the second direction X and the third direction Y.

In this embodiment, the posts are cylinders. However, the disclosure is not meant to restrict the invention. The shape of the posts can be modified. For example, in one embodiment, the posts can be square columns.

With reference to FIG. 2A, in one embodiment, the peripheral restriction portion 24 comprises a guiding slope 241 and an end surface 242, the guiding slope 241 is located between the end surface 242 and the central restriction portion 23, the guiding slope 241 corresponds to the lateral surface C6 of the chip C, and an included angle θ between the guiding slope 241 and a horizontal line H is between 65 degrees and 85 degrees. The guiding slope 241 adjusts the position of the chip C, and prevents the chip C from becoming jammed (sandwiched) between the peripheral restriction portion 24 and the bottom of the recess 11.

Figure 3:
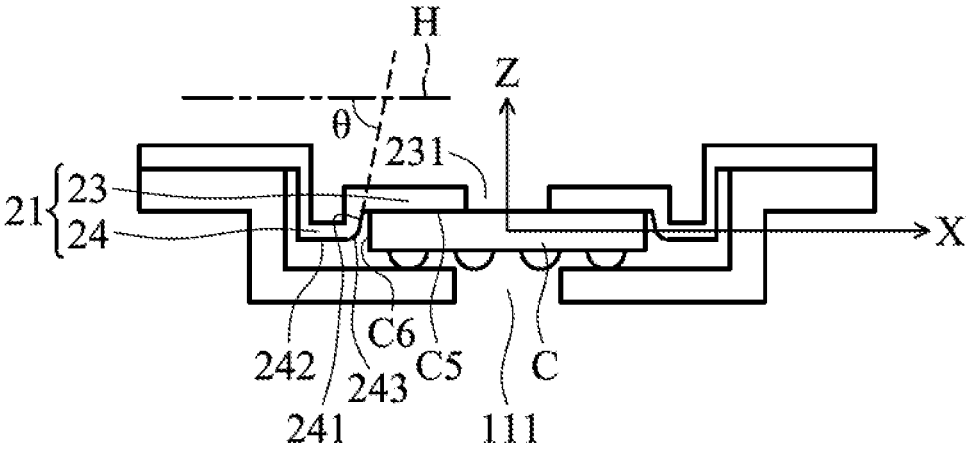
FIG. 3 shows a peripheral restriction portion of another embodiment of the invention.

With reference to FIG. 3, in one embodiment, the peripheral restriction portion 24 further comprises a rounded edge 243, and the rounded edge 243 is located between the guiding slope 241 and the end surface 242. The rounded edge 243 adjusts the position of the chip C, and prevents the chip C from becoming jammed (sandwiched) between the peripheral restriction portion 24 and the bottom of the recess 11. The rounded edge 243 also prevents the chip C from becoming jabbed and damaged.

Figure 4:
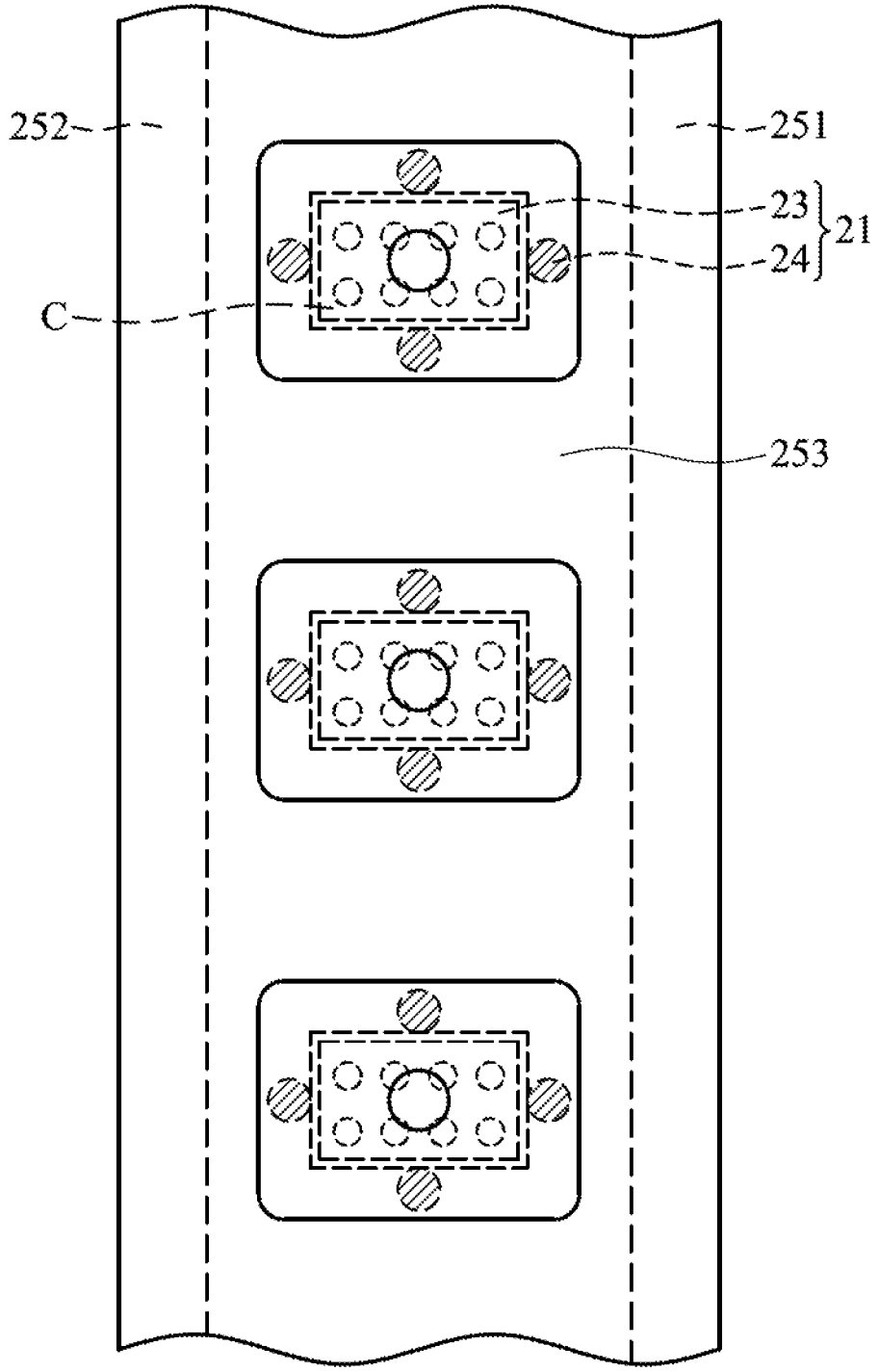
FIG. 4 shows a cover tape of one embodiment of the invention.

With reference to FIG. 4, in one embodiment, the cover tape 2 comprises a first attachment area 251, a second attachment area 252, and a restriction area 253. The first attachment area 251 is parallel to the second attachment area 252. The restriction area 253 is located between the first attachment area 251 and the second attachment area 252. The restriction structures 21 are formed on the restriction area 253. The cover tape 2 is attached to the earlier tape 1 via the first attachment area 251 and the second attachment area 252.

Figure 5:
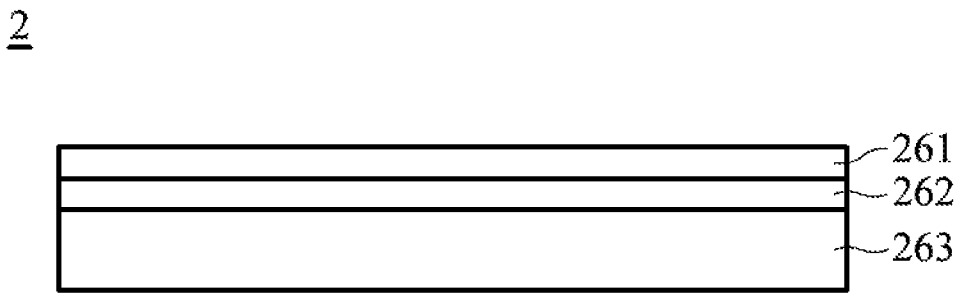
FIG. 5 is a cross-sectional view of a first attachment area or a second attachment area of the cover tape of one embodiment of the invention.

FIG. 5 is a cross-sectional view of the first attachment area 251 or the second attachment area 252 of the cover tape 2. In one embodiment, the cover tape 2 comprises a substrate 261, a tie-layer 262 and an adhesive layer 263 in the first attachment area 251 and the second attachment area 252. The tie-layer 262 is sandwiched between the substrate 261 and the adhesive layer 263. The adhesive layer 263 is adapted to attach the carrier tape 1. In one embodiment, only the substrate layer 261 is in the restriction area 253 of the cover tap 2 (not shown). In one embodiment, the substrate layer 261 can be made of plastic.

Figure 6:
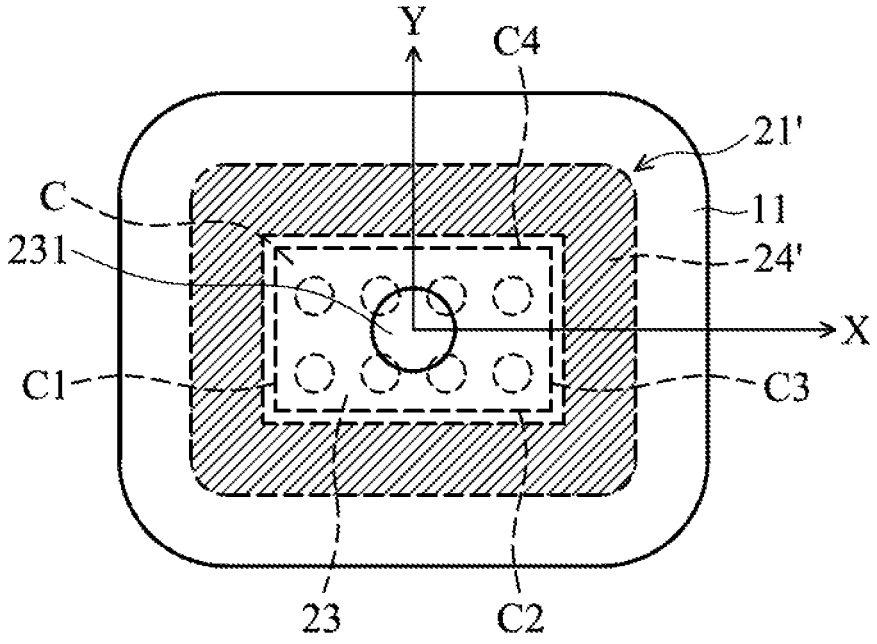
FIG. 6 is a top view of a restriction structure of another embodiment of the invention.

FIG. 6 is a top view of the restriction structure 21' of another embodiment of the invention. In one embodiment, the peripheral restriction portion 24' comprises an annular protrusion, and the annular protrusion surrounds the lateral surface of the chip C.

In the embodiments above, the peripheral restriction portion of the post and the annular protrusion are disclosed. However, the disclosure is not meant to restrict the invention. The shape of the peripheral restriction portion can be modified. For example, the peripheral restriction portion can be hemisphere protrusion, and other shaped restriction portions.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term).

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A tape and reel packing material for packaging a plurality of chips, comprising:

a carrier tape, comprising a plurality of recesses, wherein the recesses are configured to receive the respective chips; and a cover tape, attached to the carrier tape, wherein the cover tape comprises a plurality of restriction structures, and the restriction structures respectively are inserted into the recesses to restrict freedom of the chips, wherein each restriction structure comprises a peripheral restriction portion corresponds to a lateral surface of the chip, wherein the restriction structure comprises a central restriction portion, the central restriction portion corresponds to a top surface of the chip to restrict the freedom of the chip in a first direction, the peripheral restriction portion restricts the freedom of the chip in a second direction and a third direction, and the first direction is perpendicular to the second direction and the third direction, wherein the cover tape comprises a first attachment area, a second attachment area, and a restriction area, the first attachment area is parallel to the second attachment area, the restriction area is located between the first attachment area and the second attachment area, the restriction structures are formed on the restriction area, and the cover tape is attached to the carrier tape via the first attachment area and the second attachment area, wherein the cover tape comprises a substrate, a tie-layer and an adhesive layer in the first attachment area and the second attachment area, the tie-layer is sandwiched between the substrate and the adhesive layer, the adhesive layer is adapted to attach the carrier tape, and only the substrate layer is in the restriction area.

2. The tape and reel packing material as claimed in claim 1, wherein the central restriction portion comprises a first opening, and the first opening corresponds to a geometric center of the chip.

3. The tape and reel packing material as claimed in claim 2, wherein each recess comprises a second opening, and the second opening corresponds to the geometric center of the chip.

4. The tape and reel packing material as claimed in claim 1, wherein the peripheral restriction portion comprises an annular protrusion, and the annular protrusion surrounds the lateral surface of the chip.

5. The tape and reel packing material as claimed in claim 1, wherein the peripheral restriction portion comprises a plurality of posts, the lateral surface of the chip comprises a first side, a second side, a third side and a fourth side, the posts respectively correspond to the first side, the second side, the third side and the fourth side.

6. The tape and reel packing material as claimed in claim 1, wherein the peripheral restriction portion comprises a guiding slope and an end surface, the guiding slope is located between the end surface and the central restriction portion, the guiding slope corresponds to the lateral surface of the chip, and an angle between the guiding slope and a horizontal line above the end surface is between 65 degrees and 85 degrees.

7. The tape and reel packing material as claimed in claim 6, wherein the peripheral restriction portion further comprises a rounded edge, and the rounded edge is located between the guiding slope and the end surface.

* * * * *